US006382353B2

(12) United States Patent
Laug

(10) Patent No.: US 6,382,353 B2
(45) Date of Patent: May 7, 2002

(54) SLIP PREVENTION DEVICE FOR LADDERS

(76) Inventor: Horst Laug, Haselünner Strasse, D-49809 Lingen (DE)

( * ) Notice: Subject to any disclaimer, the term of this patent is extended or adjusted under 35 U.S.C. 154(b) by 0 days.

(21) Appl. No.: 09/783,688

(22) Filed: Feb. 14, 2001

Related U.S. Application Data

(63) Continuation of application No. PCT/DE99/01757, filed on Jun. 15, 1999.

(30) Foreign Application Priority Data

Aug. 14, 1998 (DE) ..... 198 36 977

(51) Int. Cl.[7] ..... E04G 5/02; E06C 7/06
(52) U.S. Cl. ..... 182/107; 182/214; 182/200
(58) Field of Search ..... 182/107, 108, 182/214, 200, 203, 201, 202; 248/188.2, 188.3, 238

(56) References Cited

U.S. PATENT DOCUMENTS

| | | | | | |
|---|---|---|---|---|---|
| 799,782 | A | * | 9/1905 | Ellinger | 182/214 |
| 1,004,284 | A | * | 9/1911 | Lehmann | 182/214 |
| 2,934,163 | A | * | 4/1960 | Ladewski | 182/214 |
| 3,459,277 | A | * | 8/1969 | Frederick | 182/214 |
| 3,713,510 | A | * | 1/1973 | O'dell | 182/107 X |
| 4,311,207 | A | * | 1/1982 | Lurry | 182/214 X |
| 4,938,312 | A | * | 7/1990 | Trail | 182/214 X |
| 5,165,501 | A | | 11/1992 | Donahey | |
| 5,341,899 | A | * | 8/1994 | Casamento | 182/107 X |
| 5,423,397 | A | * | 6/1995 | Boughner | 182/107 |
| 5,918,698 | A | * | 7/1999 | Lunn | 182/107 |
| 6,012,546 | A | * | 1/2000 | Bee et al. | 182/107 |

FOREIGN PATENT DOCUMENTS

| | | | | |
|---|---|---|---|---|
| DE | 298 14 644 U1 | | 1/1999 | |
| GB | 668050 | | 3/1952 | |
| GB | 1260476 | | 1/1972 | |
| GB | 2099060 | * | 12/1982 | 182/214 X |
| GB | 2161528 | * | 1/1986 | 182/107 X |
| WO | WO 83/02796 | | 8/1983 | |

* cited by examiner

*Primary Examiner*—David M. Purol
*Assistant Examiner*—Hugh B. Thompson
(74) *Attorney, Agent, or Firm*—Herbert L. Lerner; Laurence A. Greenberg; Werner H. Stemer

(57) ABSTRACT

In the lower area of a ladder two pull or pressure rods are arranged on either side in a pivoting manner. Via sliding sleeves and joints said rods are joined to telescopic support elements which are each arranged at the level of an upright of the ladder. For greater stability the telescopic support elements are connected to each other via an auxiliary bar whose length can also be adjusted.

16 Claims, 4 Drawing Sheets

7
1
2
7
8
8
3
3
5
5
6
6
4
1
2

1
2

6
5
4
3

6
5
3
6
5
3

10
9
A 6
5
6
5
9
9
3
3
6

5
3
A
9
12

11
10
12
6
5
3

SLIP PREVENTION DEVICE FOR LADDERS

CROSS-REFERENCE TO RELATED APPLICATION

This application is a continuation of copending International Application No. PCT/DE99/01757, filed Jun. 15, 1999, which designated the United States.

BACKGROUND OF THE INVENTION

Field of the Invention

The novel slip prevention device for ladders ensures that ladder feet are completely prevented from slipping. It is particularly suitable, also, for stairs if the feet of the lean-to ladder are placed, for example, immediately at the edge of steps because the ladder is leaning against a wall parallel to the rise of the steps.

Moreover, the slip prevention device may be fitted at the top region of the ladder and may be used as a wall support or as a roof support equipped with load-distributing bars.

The novel slip prevention device can be swung in completely parallel to the outer sides of the ladder-stringer.

On ladders of which the rungs are led through the ladder stringers and are thus open, it is her provided, in order to fasten the slip prevention device, to lead split spindles through the rung cavities from the respectively opposite sides and to screw them to one another within the ladder rungs. Centering cones on the outer sides of the split spindles allow fixed play-free bracing on all shapes and sizes of ladder rungs.

This means that the novel slip prevention device can be reliably retrofitted on all metal ladders irrespective of the make, ladder width, rung shape or rung size.

In order to prevent feet of a ladder leaning against a wall from slipping, the ladder feet are equipped with profiled rubber elements or ground spikes.

In many cases, a second person stands at the ladder foot and secures the ladder against slipping by blocking the ladder feet against slipping using his/her own feet.

As a result of local situations, it is not always possible to comply with the correct positioning angle of the lean-to ladder.

At present, it cannot be ensured that slipping of the feet of lean-to ladders is completely ruled out.

SUMMARY OF THE INVENTION

The object of the present invention is to provide a slip prevention device for ladders which overcomes the above-noted deficiencies and disadvantages of the prior art devices and methods of this general kind, and which ensures that the ladder feet are prevented from slipping even in very critical lean-to situations.

With the foregoing and other objects in view there is provided, in accordance with the invention, a slip prevention device for ladders with hollow ladder-rung profiles, wherein the slip prevention device comprises a pair of support guides, which in an articulated manner can firmly be braced on the ladder by means of divisible length-adjustable fastening spindles irrespective of the ladder width and rung geometries. It can further be folded in parallel to the longitudinal direction of the ladder, wherein every support guide includes a support which can be fully extended and secured in both longitudinal directions of the support guides. Every support guide is designed such that it is lockable on the ladder at various angles by a pull/push rod and is pivotable from the lean-to side/rear side to the front side/climbing side of the ladder.

The support guides are each fastened in an articulated manner on the threaded ends of the fastening spindles by a branching-off protrusion, wherein a threaded end on one side belongs to a threaded rod which can be screwed to a threaded bushing arranged on the opposite side and located within the ladder-rung. The threaded bushing is connected firmly to a centering cone, on the outer side of which a threaded bolt is located, wherein on a threaded rod arranged opposite a displaceable second centering cone is disposed, which can be secured by a nut.

Every pull/push rod is fitted by way of one end on a sleeve which can be displaced and secured, surrounding the corresponding support guide, and the opposite end of the pull/push rod being controllable at the projecting threaded ends of a further length-adjustable fastening spindle which can be introduced in a second ladder rung, and be braced with the aid of threaded rods, threaded bushings and centering cones, in a way that the pull/push rods are positioned in a space between the support guides and the ladder.

In one preferred embodiment of the slip prevention device for ladders according to the invention, the fastening spindles may be braced with a ladder-rung profile in a backlash-free manner.

In a further preferred embodiment of the slip prevention device for ladders according to the invention, the support guides and the supports are curved.

In another preferred embodiment of the slip prevention device for ladders according to the invention the sleeves are accordingly curved.

In a further preferred embodiment of the slip prevention device for ladders according to the invention, a length-adjustable auxiliary rod is located between the support guides.

In a further preferred embodiment of the slip prevention device for ladders according to the invention, the pull/push rods are also of length-adjustable design.

In a further preferred embodiment of the slip prevention device for ladders according to the invention, a load-distributing bar is attached to the supports in an articulated manner.

In a further preferred embodiment of the slip prevention device for ladders according to the invention, the load-distributing bar is angled at the ends. In an additional preferred embodiment of the slip prevention device for ladders according to the invention, the load-distributing bar includes supporting rollers.

In a further preferred embodiment of the slip prevention device for ladders according to the invention, a tension spring is located between the load-distributing bar and a support in a way that the load-distributing bar is retained in the swung-in position parallel to the outer side of the ladder.

Other features which are considered as characteristic for the invention are set forth in the appended claims.

Although the invention is illustrated and described herein as embodied in a slip-prevention device for a ladder, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

DESCRIPTION OF THE PREFERRED EMBODIMENTS

Figure 1:
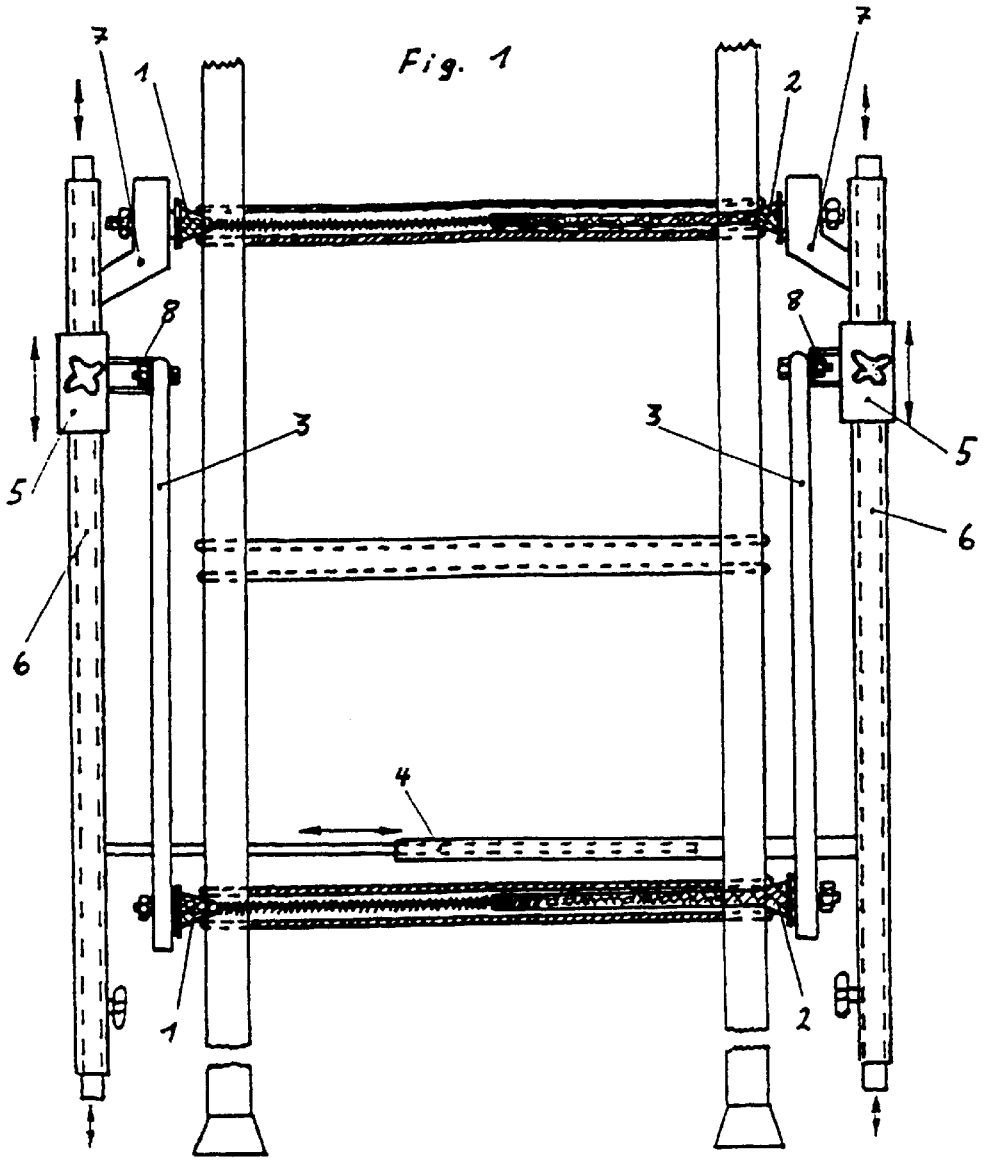
FIG. 1 is a partial front elevational view of a slip prevention device which is fitted, and swung in, at the bottom ladder region, on both sides.
Figure 2:
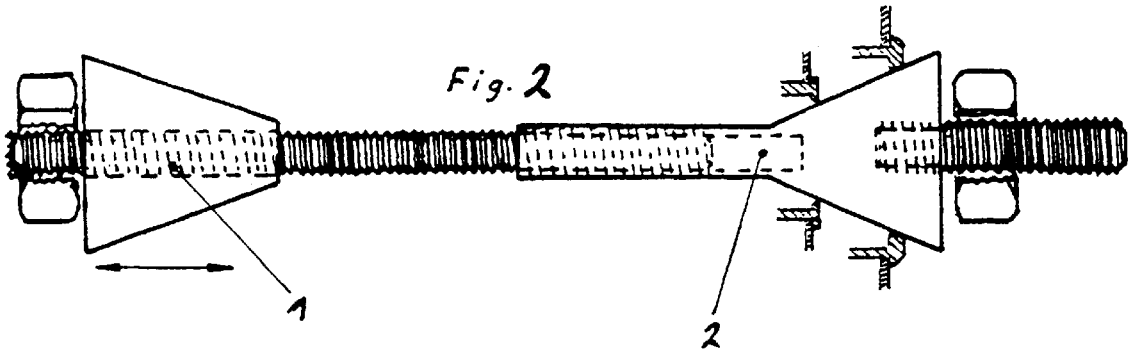
FIG. 2 is a partly diagrammatic view of split spindles in the screwed state, with a displaceable separate centering cone (1) and a threaded sleeve with a fixed centering cone (2)
Figure 5:
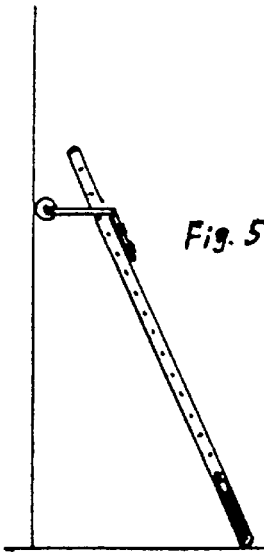
FIG. 5 shows a lean-to ladder leaning against a wall by way of a conventional wall support. The slip prevention device has been swung in parallel to the stringer.
Figure 4:
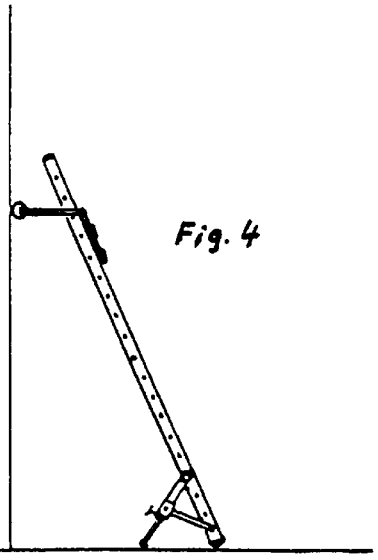
FIG. 4 shows a lean-to ladder leaning against a wall by way of a conventional wall support and secured by a rectilinear swung-out slip prevention device.
Figure 3:
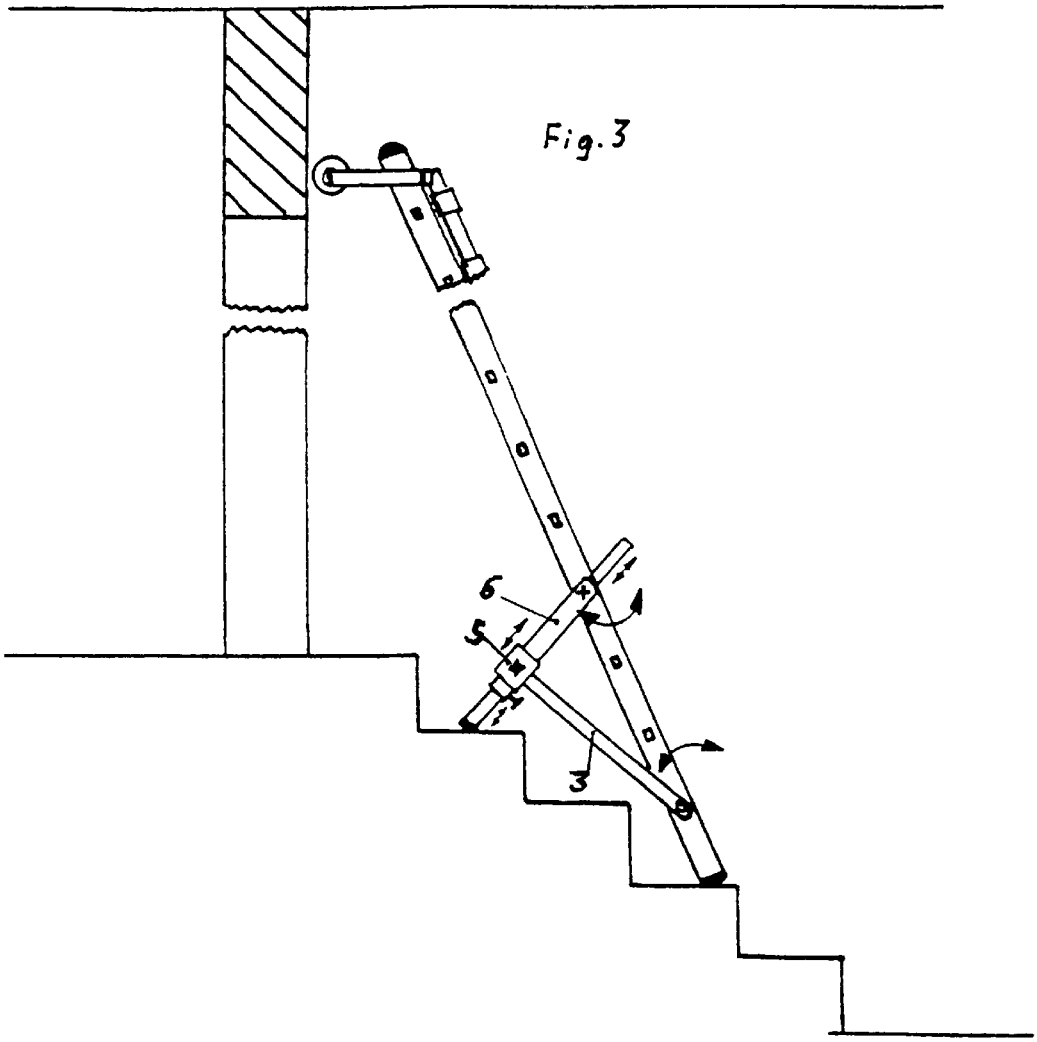
FIG. 3 shows a lean-to ladder leaning against a door lintel by way of a conventional wall support, the ladder standing on a step and being secured against slipping of the ladder feet by a rectilinear slip prevention device.
Figure 6:
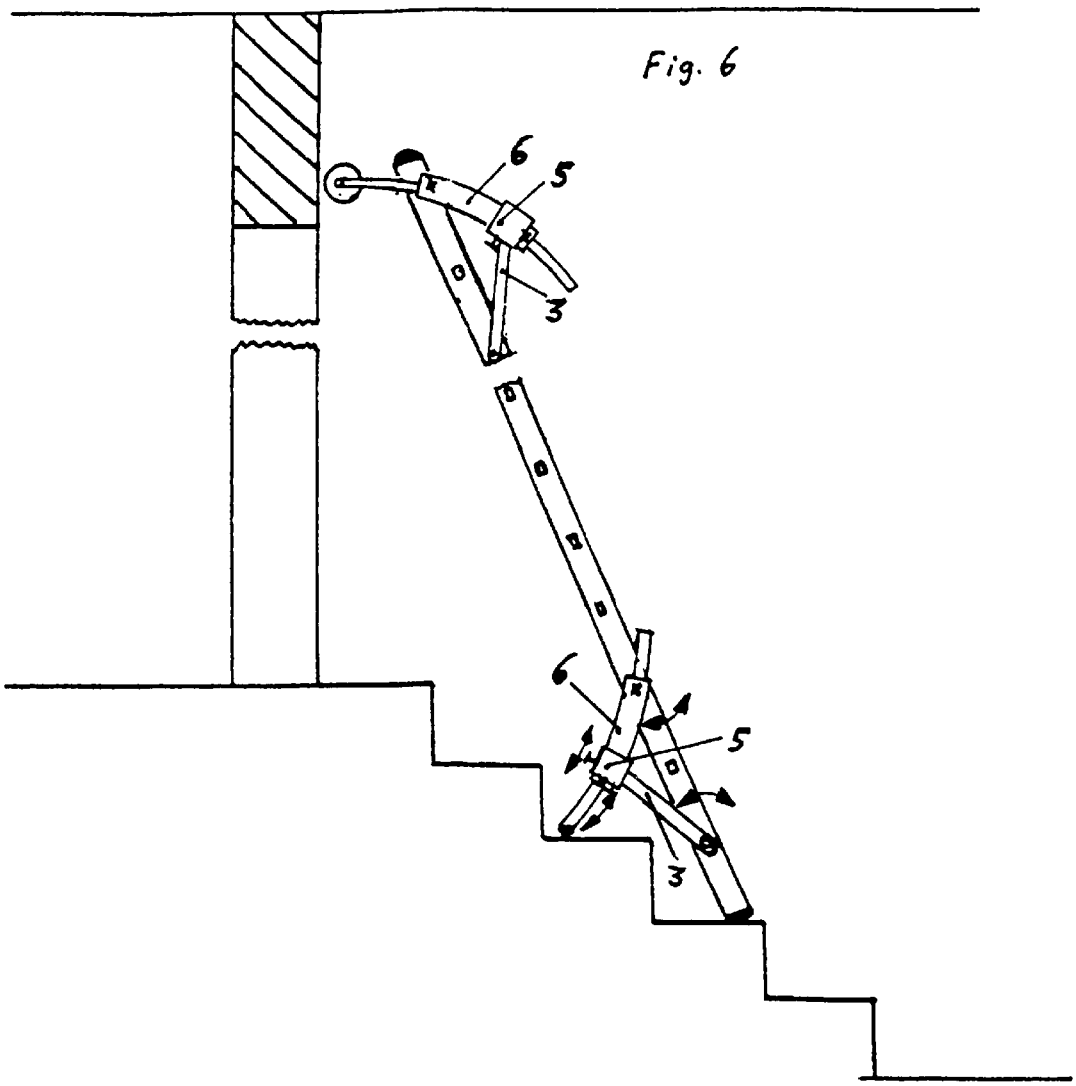
FIG. 6 shows a lean-to ladder leaning against a door lintel with the aid of a pivoted-round curved slip prevention device functioning as a wall support, the ladder standing on a step and being secured against slipping of the ladder feet by a second curved slip prevention device.

The invention ensures that the ladder feet are completely prevented from slipping even in very critical lean-to situations because curved, angle-adjustable supports 6 are fitted, said supports being fastened in an articulated manner on the ladder-stringer outer sides, in the bottom ladder region, can be swung in and out parallel to the ladder-stringer outer side, can be extended in length in both directions and are connected to pull and/or push rods 3 which are fastened in an articulated manner likewise on the ladder-stringer outer sides, the opposite side of the pull rods 3 being connected in an articulated manner to sleeves 5. The sleeves 5 are arranged on the curved supports 6 such that they can be displaced and secured, and likewise have a corresponding curvature.

The novelty resides, inter alia, in that by means of the curved supports 6 which are fastened in an articulated manner and can be extended in both directions, in conjunction with the pull and push rods 3, which are fastened in an articulated manner, and with the sleeves 5, which can be displaced and secured, the novel slip prevention device is of pivotable configuration, with the result that, merely by pivoting, for example, the lean-to side to the climbing side of the ladder, a wall support or a roof bearing or roof support is produced and the pull rod 3, by virtue of the advantageous curvature of the support 6 need not be lengthened in order to maintain the lean-to point of the resulting wall support at right angles or perpendicularly to the vertical height of the fastening point of the extensible curved supports 6 on the ladder leaning against a wall. It is merely by way of the curvature of the supports 6 that sufficient freedom of movement thus remains in the lateral direction despite the unchanged length of the pull and/or push rods 3. Furthermore, with reference to FIG. 9, the novelty resides in that a load-distributing bar 11 which is adapted to all roof inclinations may be fastened in an articulated manner at the bottom end of the extensible curved supports 6.

By virtue of the load-distributing bar 11, which is provided in an articulated manner, the bearing forces of the supports 6 on roofs are distributed uniformly over the length of the load-distributing bar 11, and punctiform loading on sensitive roof surfaces is avoided.

Figures 7, 8, 8A, 9:
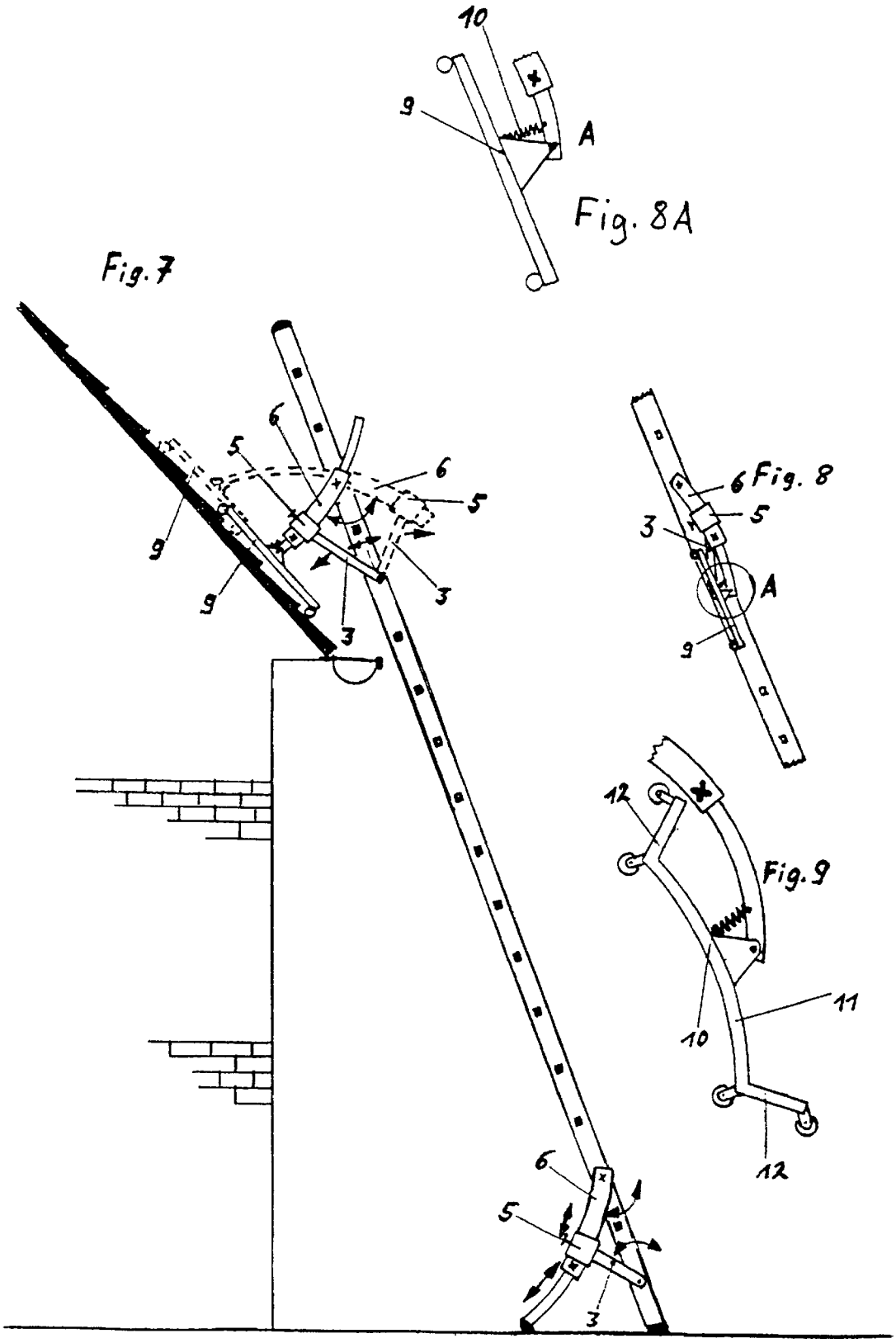
FIG. 7 shows a lean-to ladder leaning and supported against a saddleback roof with the aid of a curved slip prevention device and a load-distributing bar. In this case, the dashed drawing shows the advantage of the curved extension and retraction element of the curved support, it being possible for said element to be pivoted round and pushed through in the opposite direction. The pull rod (3) remains unchanged in terms of length.
FIG. 8 shows a curved slip prevention device on a lean-to ladder, swung in parallel to the ladder stringer, it being possible to see the further advantage of the curvature of the support (6). As a result of the space obtained in the region of the inner side of the curve of the support, the swung-in load-distributing bar (9) does not project beyond the bottom longitudinal side of the ladder stringer.
FIG. 8A shows an exploded view of the articulated fastening arrangement of FIG. 8, specifically, the load distribution bar (9) connected to the curved extension and retraction element of the support (6) by means of a tension spring (10).
FIG. 9 shows a load-distributing bar (11) which is angled (12) at the ends, curved over its length and has supporting rollers.

Still referring to FIG. 9, the load-distributing bar 11 is curved over its length and angled 12 at the ends. The curvature provides for bridging over abutment edges, projections, etc. of the roof surface in the central region of the load-distributing bar 11. The angled ends allow the load-distributing bar 11 which has been swung in on the support 6 and retained in position by spring tensioning 10, to be swung out for positioning on a roof. Easy displacement in the longitudinal direction is ensured by the rollers provided on the underside.

It proves to be particularly advantageous that, in the region of the articulated fastening, the load-distributing bar 9, 11 is connected to the curved extension and retraction element of the support 6, on the inner side of the curve, by a tension spring 10, with the result that, in addition to the supports 6 swung in parallel to the ladder-stringer outer sides, the load-distributing bars 9, 11 are also located, with the aid of the tension springs 10, parallel to the ladder stringers and do not swing out and in an uncontrolled manner.

The curvature of the extensible supports 6 provides the swung-in load-distributing bars 9, 11 with sufficient space for the load-distributing bars 9, 11 not to project beyond the ladder-stringer undersides. This advantage is a condition in order for the ladder, with the slip prevention device swung in and equipped with load-distributing bars, to be pushed, for example, onto a roof rack in an unobstructed manner without catching.

A further novelty resides in the way of fastening the slip prevention device on ladders of which the rungs are led through the ladder stringers and are open on the end sides.

The curved supports 6 have a branching-off protrusion 7 in the top region. The branching-off protrusion 7 serves for fastening the support 6 on the outer side of the ladder. This means that the curved or else rectilinear support 6 remains fully extensible or telescopic in an unobstructed manner in both directions.

At the same time, the supports 6 may be fastened in an articulated manner with the aid of split spindles, which are led through a ladder rung and are screwed within the ladder.

Conical centering stops 1 and 2 are particularly advantageous here. The conical centering stops 1 and 2 allow the split spindles to be braced within the ladder rungs irrespective of the shape and diameter of the ladder rungs, and are centered automatically when the spindles are screwed together. The supports 6 or the pull rods 3 are screwed to the threaded ends projecting on both sides. The split spindles allow the slip prevention device to be fastened on different ladder widths.

One way of implementing the invention is described as follows:

The supports 6 comprise hollow profiles and are curved over their length. Located at the top region of each support 6 is a branching-off protrusion 7 which is welded on at a distance below the end of the continuous support profile 6 which is at least equal to the hollow-profile dimension.

The branching-off protrusion 7 is fastened in an articulated manner to the ladder. Since the continuous hollow profile of the support 6 is not fastened directly on the ladder, a telescopic curved extension and retraction element may be extended and retracted in an unobstructed manner in both longitudinal directions. Furthermore, the branching-off protrusion 7 of the support 6 allows a spacing between itself and the ladder stringer, and thus a clearance, in order for the pull rod 3 to be swung in, likewise in an unobstructed manner, parallel on the ladder stringer, and to the rear of the swung-in support.

Located on the outer side of the support 6 is a sleeve 5 which is configured in accordance with the radius of curvature and the profile and is designed such that it can be displaced and secured. On one side of the sleeve 5, a pull and/or push rod 3 is fitted in an articulated and rotatable manner by way of one end. The opposite end of the pull rod 3 is provided in an articulated manner on the ladder, preferably beneath the support fastening.

For ladders of which the rungs are led through the ladder stringers, and thus have cavity openings which are accessible from the end sides, the following fastening method is recommended.

A threaded sleeve is pushed in on one side of the ladder-rung opening, the opposite end of said threaded sleeve having a centering cone 2 of which the largest external diameter is larger than the largest inner dimension of any ladder rung. In this case, the length of the threaded sleeve corresponds approximately to half the largest common ladder width. Located at the outer end of the centering cone 2 is a threaded bolt, to which the pull rod 3 or the branching-off protrusion 7 can be screwed. A threaded rod is introduced into the opposite side of the ladder-rung opening and is screwed into the threaded sleeve with fixed centering cone 2. Depending on the ladder width, the threaded rod may always be screwed in in a precisely fitting manner such that the only threaded length projecting is that which is necessary for fastening the pull rod 3 or the branching-off protrusion 7. A separate centering cone 1 has a longitudinal through-bore in the center and is pushed into the ladder rung, over the projecting threaded end, until it comes to a stop. By virtue of a nut being screwed against the centering cone 1, the two centering cones 1 and 2 press against the edge of the ladder-rung openings and center and brace themselves irrespective of the rung shape or rung dimension.

The above-described fastening method is particularly suitable for the individual retrofitting of ladder supports, etc. on ladders of different makes, ladder widths, rung dimensions and rung shapes.

Furthermore, load-distributing bars 11 are fastened in an articulated manner on one side of the two telescopic extension and retraction elements of the curved supports 6. The load-distributing bars are angled 12 at the ends and are provided with rollers at the two outer ends and in the angle region. The central region of the load-distributing bar 11 is curved over the entire length. By way of the upper side or outer side of the curve, the load-distributing bar 11 is fastened in an articulated manner on the curved telescopic support 6. A tension spring 10 is connected to the inner side of the curve of the curved extension and retraction element of the support 6 and to the outer side of the curve of the load-distributing bar 11, preferably in the articulation region.

I claim:

1. A slip prevention device for a ladder with hollow ladder-rung profiles, comprising:

a divisible length-adjustable fastening spindle configured to be guided through a hollow rung of the ladder;

a pair of support guides adapted to be articulated on and firmly braced on a respective side of the ladder by said fastening spindles, said support guides being foldable into a position parallel to a longitudinal direction of the ladder;

each said support guide including a support configured to be fully extended and secured in both longitudinal directions of said support guides;

wherein said support guides are each fastened in an articulated manner on a respective end of said fastening spindles by a branching-off protrusion, thereby defining a free space between the ladder and each said support guides;

a pull/push rod disposed in each said free space between the. ladder and said support guides and configured to lock each said support guide at various angles and pivotable from a lean-to side/rear side to a front side/climbing side of said ladder; and wherein each pull/push rod has a first end connected to a sleeve surrounding said corresponding support guide, and a second end to be articulated at a second ladder rung.

2. The slip prevention device according to claim 1, wherein said fastening spindles may be braced with said ladder-rung profile in a backlash-free manner.

3. The slip prevention device according to claim 2, wherein said support guides and said supports are curved.

4. The slip prevention device according to claim 3, wherein said sleeves are similarly curved.

5. The slip prevention device according to claim 1, wherein said support guides and said supports are curved.

6. The slip prevention device according to claim 5, wherein said sleeves are similarly curved.

7. The slip prevention device according to claim 1, wherein a length-adjustable auxiliary rod is located between said support guides.

8. The slip prevention device according to claim 1, wherein said pull/push rods are also of length-adjustable design.

9. The slip prevention device for ladders according to claim 1, including a load-distributing bar attached to each of said supports in an articulated manner.

10. The slip prevention device according to claim 9, wherein a tension spring is located between said load-distributing bar and one of said supports in a way that said load-distributing bar is retained in a swung-in position parallel to the outer side of the ladder.

11. The slip prevention device according to claim 9, wherein said load-distributing bar has ends and is angled at the ends.

12. The slip prevention device according to claim 11, wherein said load-distributing bar includes supporting rollers.

13. The slip prevention device for ladders according to claim 12, wherein a tension spring is located between said load-distributing bar and one of said supports in a way that said load-distributing bar is retained in a swung-in position parallel to the outer side of the ladder.

14. The slip prevention device according to claim 11, wherein a tension spring is located between said load-distributing bar and one of said supports in a way that said load-distributing bar is retained in a swung-in position parallel to the outer side of the ladder.

15. The slip prevention device according to claim 9, wherein said load-distributing bar includes supporting rollers.

16. The slip prevention device according to claim 15, wherein a tension spring is located between said load-distributing bar and one of said supports in a way that said load-distributing bar is retained in a swung-in position parallel to the outer side of the ladder.

* * * * *